United States Patent [19]

Matsuda et al.

[11] 4,015,449

[45] Apr. 5, 1977

[54] SLIDE FASTENER TAPE

[75] Inventors: Yoshio Matsuda, Nyuzen; Akira Nogai, Kurobe, both of Japan

[73] Assignee: Yoshida Kogyo Kabushiki Kaisha, Japan

[22] Filed: Apr. 17, 1975

[21] Appl. No.: 569,097

[30] Foreign Application Priority Data

Apr. 25, 1974 Japan ..... 49-46902

[52] U.S. Cl. ..... 66/195; 24/205.1 C; 24/205.16 C

[51] Int. Cl.[2] ..... D04B 21/00; A44B 19/00

[58] Field of Search ..... 24/205.1 C, 205.16; 66/190–195

[56] References Cited

UNITED STATES PATENTS

| | | | |
|---|---|---|---|
| 2,652,705 | 9/1953 | Weinberg | 66/193 |
| 2,903,775 | 9/1959 | Johns | 24/205.16 |
| 3,820,202 | 6/1974 | Takamatsu | 24/205.1 C |
| 3,848,556 | 11/1974 | Terada et al. | 66/190 X |
| 3,874,036 | 4/1975 | Yoshikawa | 24/205.1 C |

FOREIGN PATENTS OR APPLICATIONS

| | | | |
|---|---|---|---|
| 6,407,991 | 10/1965 | Netherlands | 66/193 |

*Primary Examiner*—Ronald Feldbaum
*Attorney, Agent, or Firm*—Bucknam and Archer

[57] ABSTRACT

A slide fastener stringer tape of a warp-knitted structure is disclosed which is adapted for mounting thereon a row of interlocking fastener elements. The warp-knitted stringer tape has the interwale groove at the tape edge along and through which a line of element-sewing stitches passes. The interwale groove is defined between the outermost wale and an adjoining wale and is provided therein solely with tricot sinker loops which connect these wales together in each course. This arrangement is such that the sewing needle can be directed to and through any optional position of the interwale groove without having regard to the position of the courses.

2 Claims, 5 Drawing Figures

SLIDE FASTENER TAPE

BACKGROUND OF THE INVENTION

This invention relates to slide fasteners and particularly to stringer tapes of a warp-knitted structure for mounting thereon rows of interlocking fastener elements.

There are known various types of warp-knitted tapes for use in the field of slide fasteners or zippers. Warp-knitted tapes of the known type onto which interlocking fastener elements are sewn are basically constructed with longitudinally extending chain stitches which form a multiplicity of wales and transversely extending lapping threads laid in to connect the wales coursewise so as to solve the inherent problem of "stretch" in the knitted fabric which occurs when subjected to external stresses exerted in normal use of the slide fastener. With these prior art warp-knitted tapes, the arrangement of the laid-in lapping threads at the element-supporting tape edge is that the lapping threads form u-turns in every two courses at the outermost wale adjacent to a line of sewing stitches which secures the fastener elements to the tape edge. In other words, the element-supporting tape edge includes a first group of courses where lapping threads are located and a second group of courses free of lapping threads, the second courses tending to yield themselves at the tape edge portion to a greater stretch weftwise than the first courses when lateral stresses are exerted on the tape fabric.

This has led to the drawback that the sewing stitches run longitudinally across and pass through these two different groups of courses at the element-supporting edge, thereby creating irregularities in the positional stability of a row of fastener elements secured to the tape edge during the use of the slide fastener. The prior art tape structures are therefore prone to reduce the mechanical strength of the resulting slide fastener against stresses tending to bend or split apart the coupled slide fastener.

One solution to this drawback would be to see to it that the sewing needle passes exactly through only the courses at the tape edge where the inlaid lapping threads are devoid and that the sewing pitch registers with such courses. However, it would be difficult to reduce this proposal to practice when taking into account the inherent flexibility and stretch of the knitted tape and the shape of a given fastener element.

SUMMARY OF THE INVENTION

In view of the above-noted prior art drawback, the principal object of the invention is to provide a stringer tape of a warp-knitted structure which is formed in such a manner as to permit the sewing stitches to pass freely and smoothly longitudinally through the element-supporting edge without particular regard to the courses for needle passage.

Another object of the invention is to provide a stringer tape of a warp-knitted structure which ensures a high degree of positional stability of the fastener elements mounted thereon and accordingly enhances the mechanical strength of the resulting slide fastener.

These and other objects and features of the invention will appear more clear form the following detailed description taken in connection with the accompanying drawings which illustrate by way of example some preferred embodiments. Like reference characters or numerals refer to like parts throughout the several views.

DESCRIPTION OF THE PREFERRED EMBODIMENTS

Figure 1:
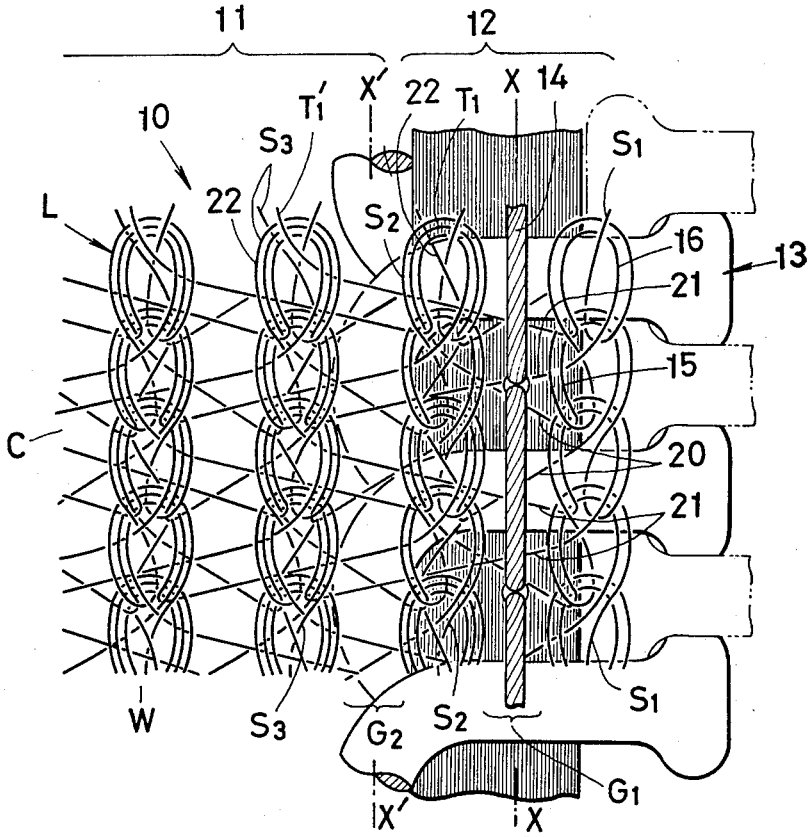
FIG. 1 is an enlarged view diagrammatically illustrating the construction of the reverse side of a warp-knitted tape in accordance with an embodiment of the invention.
Figure 2:
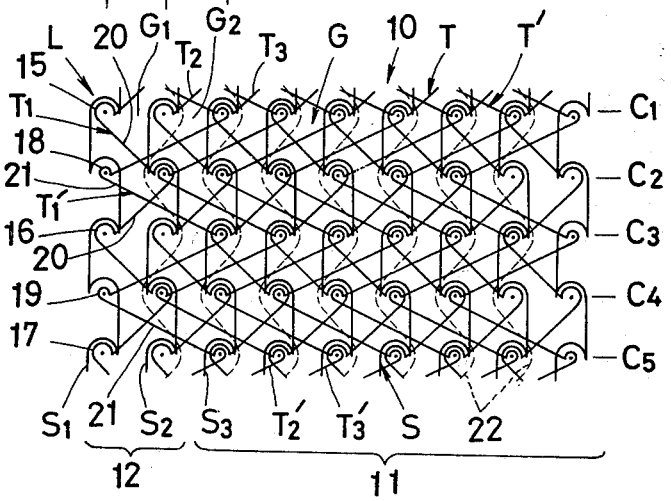
FIG. 2 is a diagram showing the structure of the warp-knitted tape shown in FIG. 1.

Referring now to the drawings and FIGS. 1 and 2 in particular, there is shown a warp-knitted tape 10 for use as a support for mounting thereon fastener elements. The warp-knitted tape 10 of this invention is formed with longitudinally extending chain stitches $S_1$, $S_2$, $S_3$, . . . $S_n$ and two kinds of tricot stitches or formations $T_1$, $T_2$, . . . $T_n$ and $T'_1$, $T'_2$, . . . $T'_n$ connecting the chain stitches S coursewise. Designated at $W_1$,$W_2$, W3, . . . $W_n$ are wales which are formed principally by the chain stitches S and $C_1$, $C_2$, $C_3$, . . . $C_n$ are courses which indicate rows of loops L extending transversely of and across the tapes 10. The tape 10 includes a web portion 11 and a marginal edge portion 12 to which a row of fastener elements 13 is secured in an interwale groove $G_1$ along a line a line x−x.

In accordance with an important concept of the invention, a first tricot stitch $T_1$ at the marginal edge portion 12 is interknitted with the wales $W_1$ and $W_2$ in each course to provide needle loops such as at 15, 16, and 17 at the outermost wale $W_1$ in the courses $C_1$, $C_3$, and $C_5$, respectively. A second tricot stitch $T'_1$ at the marginal edge portion 12 is interknitted with the wales $W_1$ and $W_3$ in each course to provide needle loops such as at 18 and 19 at the outermost wale $W_1$ in the courses $C_2$ and $C_4$ respectively. In order to produce this tricot stitch pattern, the yarn guide bar (not shown) for the tricot stitch $T'_1$ is moved in a direction opposite to the tricot stitch $T_1$. As seen in FIGS. 1 and 2, the outermost wale $W_1$ is thus connected to the wales $W_2$ and $W_3$ only by the tricot stitches $T_1$ and $T'_1$ in each course without using any transversely extending lapping threads as used in the conventional warp-knitted fastener tapes. It will be appreciated that the interwale groove $G_1$ through which the sewing stitch 14 passes is provided with sinker loops 20 and 21 of the tricot stitches $T_1$ and $T'_1$, respectively, which sinker loops are uniformly distributed in crossing relation with each other within the groove $G_1$ throughout the full length of the tape 10. Designated at reference numeral 22 are additional reinforcing warp threads running along the wales W in a direction to close the open laps of the loops L to prevent the tape 10 from stretching in the warpwise direction. Alternatively, the reinforcing warp threads 22 may be inserted linearly in the interwale grooves G and held in position by the sinker loops as at 20 and 21 of the tricot stitches $T_1$ and $T'_1$. However, for the ultimate purpose of the invention, these warp threads may be dispensed with.

Figure 3:
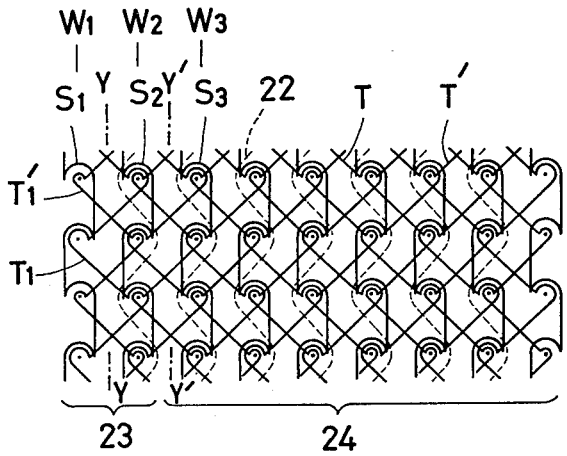
FIG. 3 is a view similar to FIG. 2, but showing the structure of another embodiment of the invention.

Another embodiment shown in FIG. 3 is substantially the same as the first embodiment with the exception that the wales $W_1$ and $W_2$ at the marginal edge portion 23 are interconnected by tricot stitches $T_1$ and $T'_1$. The tricot stitch $T_1$ has the same lay as that of the first embodiment depicted in FIGS. 1 and 2, whereas the tricot stitch $T'_1$ is interknitted with the wales $W_1$ and $W_2$ in a symmetrical relation to the pattern of the tricot stitch $T_1$. Thus, the wale $W_1$ extending outwardly of a line Y — Y along which sewing stitches 14 pass is connected to the wale $W_2$ by the tricot stitches $T_1$ and $T'_1$ in each course.

Figure 5:
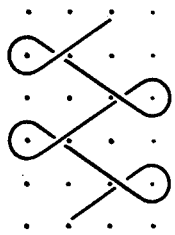
FIG. 5 is a view similar to FIG. 4, but showing still another embodiment.
Figure 4:
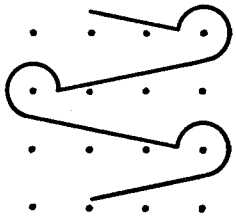
FIG. 4 is a diagram utilized to explain the lay of a tricot stitch provided in accordance with another embodiment of the invention.

FIGS. 4 and 5 show respectively the lays of another embodiment of the tricot stitch which connects the wales course-wise. In these embodiments, the tricot stitch extends transversely across every four wales to connect the outermost wales coursewise.

It will be appreciated that the interwale groove $G_1$ adapted for the passage of the sewing needle is defined between the outermost wale $W_1$ in the tape edge and an adjoining wales $W_2$, which wales are interconnected solely by tricot sinker loops in each course, the arrangement being that the sewing needle can be directed to through any optional position of the interwale groove $G_1$ irrelative to the position of the courses with the result that the sewing stitches are secured relative to the tape edge with uniform stability and all individual fastener elements are affixed to the tape edge with uniform strength throughout the entire tape length.

This in turn ensures uniform positional stability of the secured fastener elements 13 throughout the full length of the slide fastener against possible partial displacement which might occur under severe external stresses tending to bend or split apart the coupled slide fastener. Another advantage is that the interwale grooves at the element-supporting edge are formed with tricot sinker loops which impart moderate flexibility to the wales $W_1$ and $W_2$ such that they may move transversely relative to each other to facilitate the passage of the sewing needle therebetween during the sewing operation. In accordance with the invention, therefore, the sewing needle can be directed to and through any optional position of the interwale groove of the tape without having regard to the courses and hence, the speed of sewing the fastener elements to the tape can be increased manifold. Since the wales $W_2$ and $W_3$ are also interconnected solely by the tricot stitches, the sewing stitches may be directed alternatively through a second interwale groove $G_2$ along a line X' — X' (FIGS. 1 and 2) or a line Y' – Y' (FIG. 3). The web portion 11 or 24 may be formed with stitches different from those used in the marginal edge portions 12 and 23.

Although various preferred embodiments have been described for illustrative purposes only, it should be understood that variations or modifications thereof which lie within the scope of the appended claims are fully contemplated.

What is claimed is:

1. A stringer tape of a warp-knitted structure for mounting thereon a row of interlocking fastener elements, comprising a web portion and a marginal edge portion to which the row of interlocking fastener elements is secured by a line of sewing stitches, said marginal edge portion including an outermost wale extending outwardly of said line of stitches and tricot stitches connecting each course of said outermost wale to a corresponding course in an adjoining wale, and said line of stitches passing through sinker loops of said tricot stitches interconnecting said outermost wale and adjoining wale said tricot stitches being the sole connection between said outermost and adjoining wales.

2. A stringer tape as defined in claim 1, including tricot stitches defining a first and a second tricot formation, said first tricot formation being interknitted with said outermost wale and adjoining wale extending inwardly of said line of stitches, and said second tricot formation being interknitted with said outermost wale and a third wale extending inwardly of said adjoining wale.

* * * * *